US009236687B2

(12) United States Patent
Aldereguia et al.

(10) Patent No.: US 9,236,687 B2
(45) Date of Patent: Jan. 12, 2016

(54) CABLE CONNECTOR

(71) Applicant: GLOBALFOUNDRIES INC., Grand Cayman (KY)

(72) Inventors: Alfredo Aldereguia, Cary, NC (US); Jeffrey R. Hamilton, Pittsboro, NC (US); Clifton E. Kerr, Durham, NC (US); Grace A. Richter, Raleigh, NC (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 20 days.

(21) Appl. No.: 13/974,213

(22) Filed: Aug. 23, 2013

(65) Prior Publication Data

US 2015/0056838 A1 Feb. 26, 2015

(51) Int. Cl.

*H01R 13/62* (2006.01)
*H01R 13/633* (2006.01)
*H01R 13/627* (2006.01)

(52) U.S. Cl.

CPC ..... *H01R 13/633* (2013.01); *H01R 13/6275* (2013.01); *H01R 2201/06* (2013.01)

(58) Field of Classification Search

CPC ..... H01R 13/629
USPC ..... 439/345, 545, 536, 557, 570, 571, 680, 439/681, 357, 358
See application file for complete search history.

(56) References Cited

U.S. PATENT DOCUMENTS

| | | | | |
|---|---|---|---|---|
| 3,638,171 | A | 1/1972 | Huibrechtse | |
| 4,508,404 | A | 4/1985 | Frawley | |
| 4,547,028 | A | 10/1985 | Morgan et al. | |
| 4,671,590 | A | 6/1987 | Ignasiak | |
| 4,702,542 | A * | 10/1987 | Noyes | 439/347 |
| 5,033,972 | A * | 7/1991 | Komatsu et al. | 439/153 |
| 5,154,629 | A * | 10/1992 | Carver et al. | 439/352 |
| 5,613,865 | A | 3/1997 | Dullin et al. | |
| 5,741,150 | A * | 4/1998 | Stinson et al. | 439/358 |
| 6,174,178 | B1 | 1/2001 | Reinhold | |
| 6,276,956 | B1 | 8/2001 | Cook | |
| 6,305,986 | B1 * | 10/2001 | Hwang | 439/607.44 |
| 6,802,727 | B2 | 10/2004 | Geilow et al. | |
| 7,004,772 | B1 | 2/2006 | Hsiao et al. | |
| 7,104,832 | B2 | 9/2006 | Campbell et al. | |
| 7,494,375 | B2 | 2/2009 | Yoshikai | |
| 7,811,139 | B1 | 10/2010 | Parikh et al. | |
| 2010/0037554 | A1 | 2/2010 | Oh | |

FOREIGN PATENT DOCUMENTS

EP 0872915 A2 10/1998

* cited by examiner

*Primary Examiner* — Felix O Figueroa
*Assistant Examiner* — Paul Baillargeon
(74) *Attorney, Agent, or Firm* — Thompson Hine LLP

(57) ABSTRACT

Embodiments provide for a cable connector for coupling a cable with a device having a mating connector. The cable connector includes a cable connector body having a device end, a cable end, a bottom side, and a pivot point on the bottom side between the device and cable ends. Also, the cable connector includes a strut having a first strut end pivotally coupled with the pivot point and a second strut end. The strut is operable to rotate between a retracted position and an actuated position. The second strut end is adapted to engage the device on a surface of the device below the mating connector in the actuated position.

8 Claims, 4 Drawing Sheets

CABLE CONNECTOR

TECHNICAL FIELD

Embodiments described herein generally relate to testing electronic components, and more specifically, to a cable connector.

BACKGROUND

Cable connectors may be mechanical assemblies for joining electrical circuits. Cable connectors may join two lengths of flexible wire, cable, or optical interface to an electrical terminal. Cable connectors may be referred to as a physical interface in computing. The connection using cable connectors may be temporary, require a tool for removal, or serve as permanent connectors. These cable connectors may employ a threaded member, e.g. a screw, as a locking mechanism to prevent the cable from disengaging from the electrical terminal under normal use.

SUMMARY

Embodiments of the disclosure provide a cable connector for coupling a cable with a device having a mating connector. The cable connector includes a cable connector body having a device end, a cable end, a bottom side, and a pivot point on the bottom side between the device and cable ends. Also, the cable connector includes a strut having a first strut end pivotally coupled with the pivot point and a second strut end. The strut is operable to rotate between a retracted position and an actuated position. The second strut end is adapted to engage the device on a surface of the device below the mating connector in the actuated position.

Another embodiment includes a cable connector for coupling a cable with a device having a mating connector. The cable connector includes a cable connector body having a device end, a cable end, a bottom side, and a recess on the bottom side between the device end and the cable end. The cable connector includes slider disposed on tracks on the bottom side at the cable end. The slider has a first position and a second position. The cable connector also includes a rod having a first rod end and a second rod end. The first rod end is coupled to the slider. The cable connector further includes a strut having a first strut end and a second strut end. The first strut end is pivotally coupled to the second rod end. The strut is operable to rotate between a retracted position and an actuated position in response to the slider sliding from the first position to the second position. The second strut end is adapted to engage a surface of the device below the mating connector in the actuated position.

BRIEF DESCRIPTION OF THE DRAWINGS

Embodiments are illustrated by way of example, and not by way of limitation, in the figures of the accompanying drawings in which like reference numerals refer to similar elements or steps.

DETAILED DESCRIPTION

Figure 1:
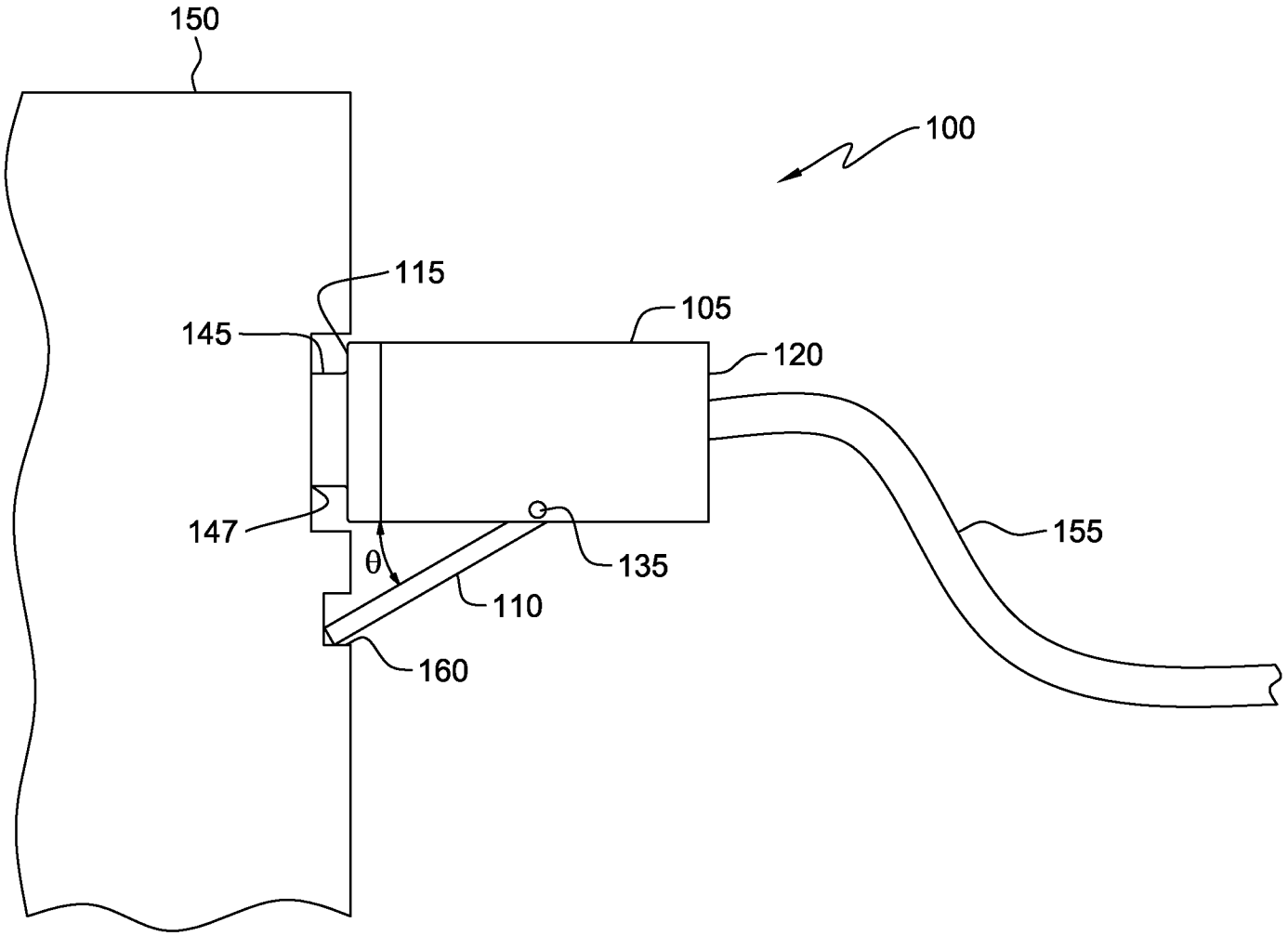
FIG. 1 illustrates a side view of a cable connector engaged with a terminal, according to an embodiment.

Embodiments herein provide for a cable connector. Features illustrated in the drawings are not necessarily drawn to scale. Descriptions of well-known components and processing techniques are omitted so as to not unnecessarily obscure the disclosed embodiments. The descriptions of embodiments are provided by way of example only, and are not intended to limit the scope of the invention as claimed.

Cable connectors that connect a cable to a terminal of a device to create a secure connection may have a locking mechanism to temporarily or permanently connect the cable to the terminal of the device. Some of these locking mechanisms for temporary connections may be threaded mechanisms such as screws. D-shell type connectors such as VGA DE-15 and ITE dongle are examples of connectors that have screw-in locking mechanisms. A user may ignore and not use a threaded mechanism because the user is rushed or only plans to connect the cable connector for a short period of time.

Embodiments herein provide for a cable connector that may include a mechanical strut that securely connects the cable connector to a mating connector of a device. The strut uses the gravitational force exerted on the cable connector and cable to support the connection of the cable connector to the mating connector instead of or in addition to other locking mechanisms. The cable connector may allow quick connection and removal of the cable connector from the mating connector when connections are performed.

FIG. 1 illustrates a side view of a cable connector 100, according to an embodiment. The cable connector 100 may include a cable connector body 105, and a strut 110. The cable connector body 105 may include a device end 115 and a cable end 120. The cable connector body 105 in FIG. 1 is illustrated as a rectangular prism, however, shapes such as a cylindrical shape or other polygon shapes may be considered for the cable connector body 105. At the device end 115 of the cable connector body 105, there may be a cable connector terminal 145. The cable connector terminal 145 may provide a communicative coupling between the cable connector 100 and a mating connector 147 of a device 150. At the cable end 120, a cable 155 carrying electrical or optical signals may be coupled with the cable connector body 105 so that it is in operable communication with the device 150 when the cable connector terminal 145 is coupled to the mating connector 147.

The strut 110 may have a first strut end and a second strut end. The first strut end may be coupled to the cable connector body 105 at a pivot point 135 between the device end 115 and the cable end 120 of the cable connector body 105. The pivot point 135 may be on a bottom side of the cable connector body 105. The first strut end may be pivotally coupled to the cable connector body 105. The pivotal coupling of the first strut end allows the strut 110 to rotate between an actuated position and a retracted position. When the strut 110 is in the actuated position, the pivotal coupling of the first strut end allows the second strut end to actuate away from the cable connector body 105 so the strut 110 may be at an angle in relation to the cable connector body 105. When the strut 110 is in the retracted position, the second strut end may be retracted into or onto a surface of the cable connector body 105. The retracted position essentially makes the angle zero of the strut 110 to the cable connector body 105 since the strut 110 may be parallel to a surface of the cable connector body 105.

When the cable connector 100 engages with the mating connector 147 of the device 150, the strut 110 may be moved into an actuated position. The second strut end may actuate out from the surface of the cable connector body 105 at the angle. In an embodiment, the strut 110 may engage a strut receptacle 160 in the device 150. In an embodiment, the strut receptacle 160 may be a notch in the device 150. In other embodiments, the strut receptacle 160 may be a ledge the strut 110 may engage. In other embodiments, the strut 110 may engage the surface of the device 150. The angle of the strut 110 in the actuated position may be an angle appropriate to engage the strut receptacle 160. In an embodiment, the angle may be acute to the cable connector body 105. While the cable connector body 105 is connected with the device 150, the strut 110 may support the weight of the cable 155 and the cable connector 100 which may otherwise disengage the cable connector terminal 145 from the mating connector 147. To put the strut 110 in an actuated position or retracted position the strut 110 may be manually pivoted. In an embodiment, the pivot point 135 may include a hinge or a pin that allows the strut 110 to rotate about the pivot point 135. In an embodiment, the pivot point 135 may be regulated to allow the strut to only actuate to a maximum angle. In an embodiment the pivot point 135 may be locked when the strut 110 is at its desired angle to prevent the strut 110 from rotating.

Figure 2A:
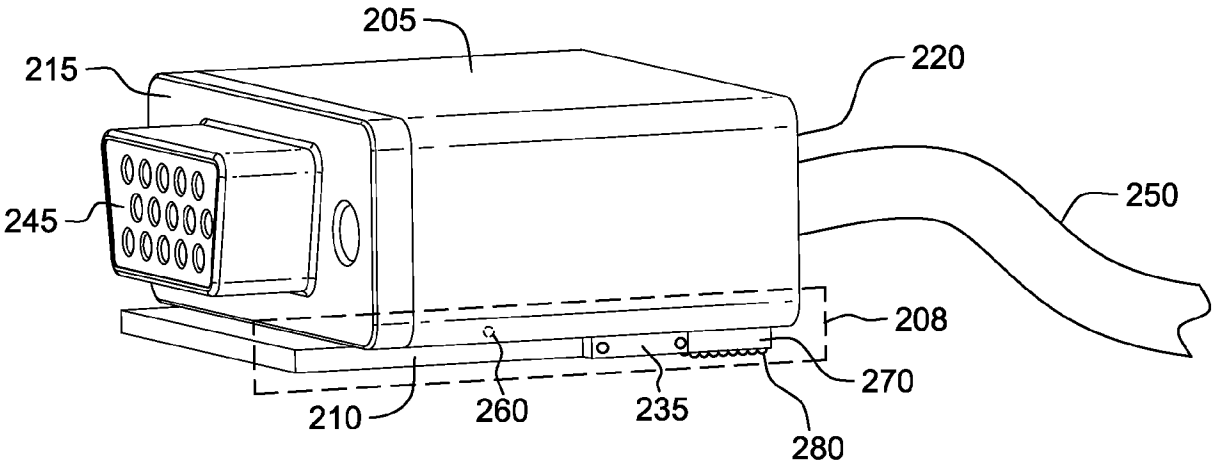
FIG. 2A illustrates a perspective view of an alternative embodiment of a strut assembly of the cable connector when in a retracted position of FIG. 1, according to an embodiment.

FIG. 2A illustrates a perspective view of a cable connector 200 in a retracted position, according to an embodiment. The cable connector 200 may include a cable connector body 205, and a strut assembly 208. The cable connector body 205 may include a device end 215 and a cable end 220. The cable connector body 205 in FIG. 2A is illustrated as a rectangular prism, however, shapes such as a cylindrical shape or other polygon shapes may be considered for the cable connector body 205. At the device end 215 of the cable connector body 205, there may be a cable connector terminal 245. The cable connector terminal 245 may provide a communicative coupling between the cable connector 200 and a mating connector 147 of the device 150 of FIG. 1. At the cable end 220, a cable 250 carrying electrical or optical signals may be coupled with the cable connector body 205 so that it is in operable communication with the device 150 when the cable connector terminal 245 is coupled to the mating connector 147.

The strut assembly 208 may include a strut 210, a rod 235, a slider 270 and a deflector 260. The strut assembly 208 may be at the bottom side of the cable connector body 105. The strut 210 may have a first strut end and a second strut end. The rod 235 may have a first rod end and a second rod end. The first strut end may be pivotally coupled with the rod 235 at the second rod end. The slider 270 may also be pivotally coupled with the first rod end. The strut 210 may be closer to the device end 215 and the slider 270 may be closer to the cable end 220.

The strut assembly 208 may also include a deflector 260, in an embodiment. The deflector 260 may engage the strut 210 at a point between the first strut end and the second strut end 230. In an embodiment, the strut assembly 208 may be attached to a surface of the cable connector body 205. In another embodiment, the strut assembly 208 may be within the cable connector body 205. The cable connector body 205 may have a recess at the bottom side within it to allow the components of the strut assembly 208 to move up within cable connector body 205. The cable connector body 205 may also contain a track 285 (FIG. 2B) on which the slider 270 may be disposed to allow the slider 270 to move between its first position and second position. The slider 270 may also have one or more knobs 280 to aide a user in gripping the slider while moving it.

Figure 2B:
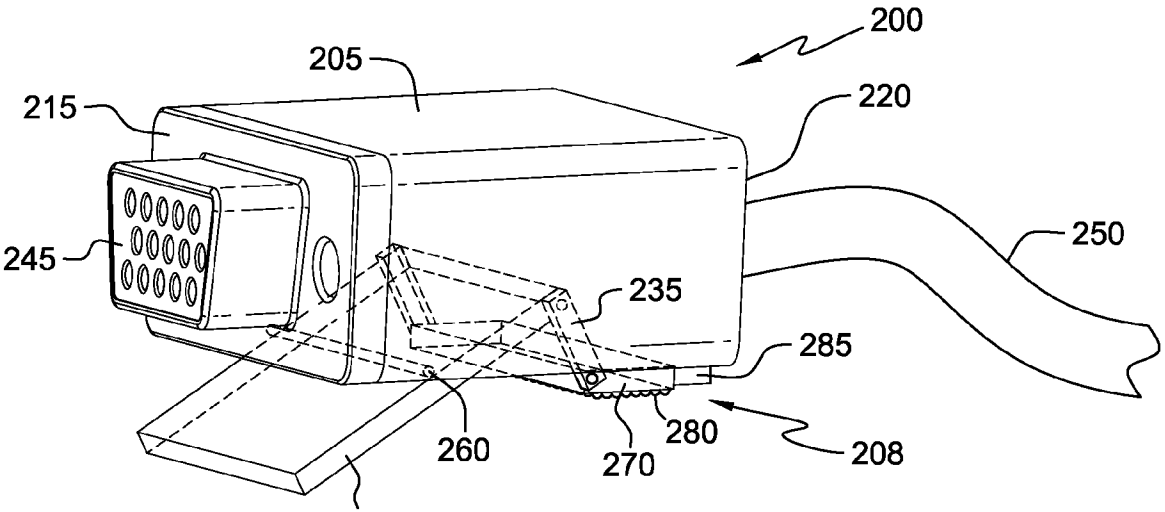
FIG. 2B illustrates a perspective view the cable connector of FIG. 2A when the strut assembly is actuated, according to an embodiment.

FIG. 2B illustrates a perspective view of the cable connector 200 in an actuated position, according to an embodiment. In FIG. 2B, to actuate the strut 210 a user may push the slider 270 from its first position toward the device end 215 of the cable connector 200. The deflector 260 may deflect the strut 210 as the slider 270 is being moved toward the device end 215 in the second position. The rod 235 may actuate up into a recess in the cable connector body 205 when force is exerted on it from the slider 270. Due to the rod 235 actuating up into the recess, the strut 210 may also be moved to an angle from a surface of the cable connector body 205. To return to a retracted position, the slider 270 may be slid toward the cable end 220 of the cable connector body 205. The slider 270 may be able to be locked or require more force to return the slider 270 to the first position from the second position than the force exerted on the strut 210 from the device 150 of FIG. 1 when the cable connector 200 is engaged with the device 150. This is so that the strut 210 does not move to the retracted position when it is engaged with the device 150

Figure 3:
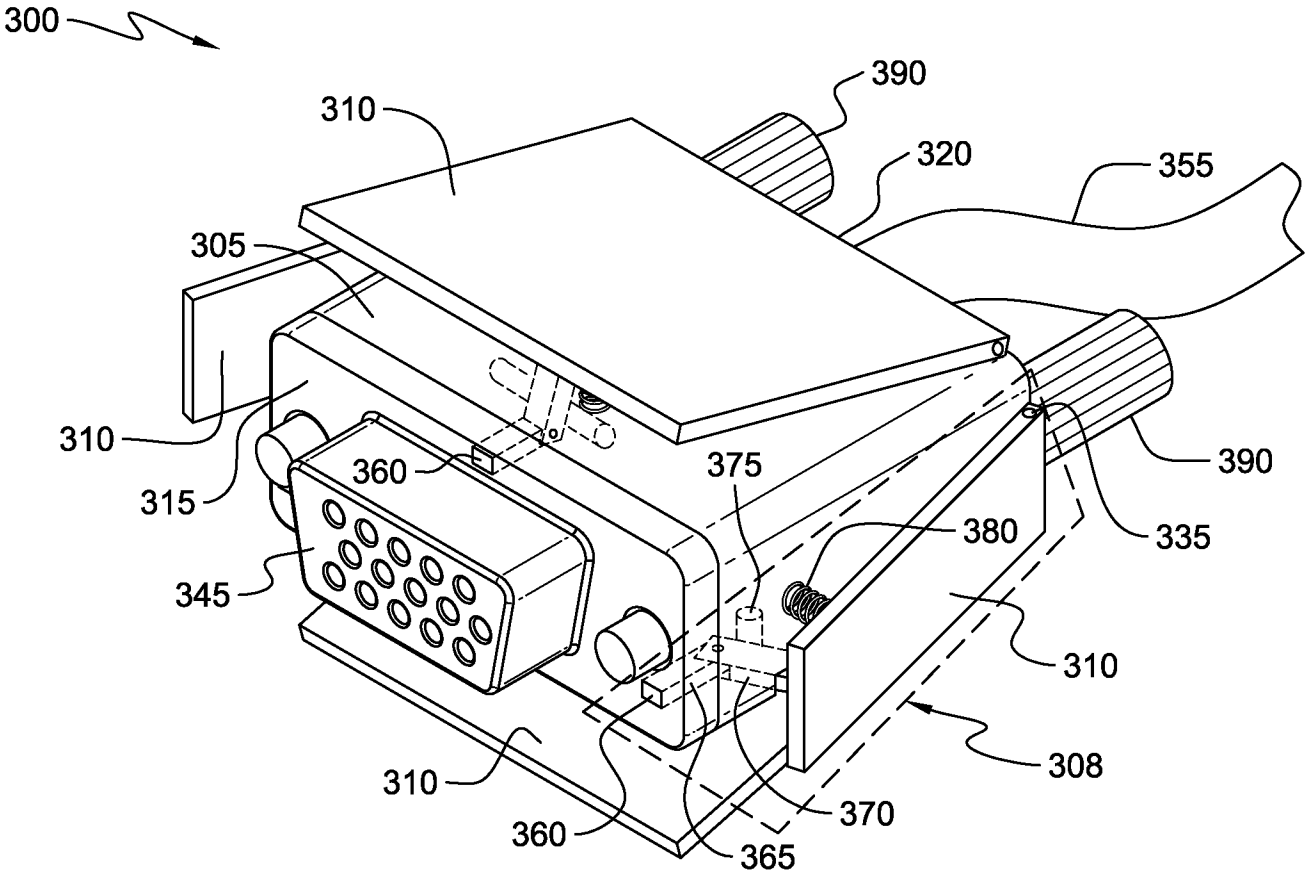
FIG. 3 illustrates a perspective view of the cable connector of FIG. 1 with an alternative strut assembly, according to an embodiment.

FIG. 3 illustrates a perspective view of a cable connector 300 in an actuated position, according to an embodiment. The cable connector 300 may include a cable connector body 305, and an alternative embodiment of a strut assembly 308. The cable connector body 305 may include a device end 315 and a cable end 320. The cable connector body 305 in FIG. 3 is illustrated as a rectangular prism, however, shapes such as a cylindrical shape or other polygon shapes may be considered for the cable connector body 305. At the device end 315 of the cable connector body 305, there may be a cable connector terminal 345. The cable connector terminal 345 may provide a communicative coupling between the cable connector 300 and, for example, a mating connector 147 of the device 150 of FIG. 1. At the cable end 320, a cable 355 carrying electrical or optical signals may be coupled with the cable connector body 305 so that it is in operable communication with the device 150 when the cable connector terminal 345 is coupled to the mating connector 147 of FIG. 1.

The cable connector 300 may include an additional securing mechanism for an alternate connection between the device and cable connector 300. FIG. 3 illustrates one or more cable connector screws 390 as an additional securing mechanism. The cable connector screws 390 may run through the cable connector body 305. The head of the cable connector screw 390 may be at the cable end 320 and the securing end of the cable connector screws 390 may be at the device end 315 to engage the device 150.

The strut assembly 308 may be an automatic strut assembly. The strut assembly 308 may include a strut 310, a button 360, a first rod 365, a second rod 370, a deflector 375, and a spring 380. The strut assembly 308 may be located on the bottom side of the cable connector body 305. The strut 310 may have a first strut end and a second strut end. The first strut end may be pivotally coupled to a pivot point 335 (e.g. pin or hinge) between the device end 315 and cable end 320 of the cable connector body 305. The button 360 may be external to the device end 315 of the cable connector body 305. The button 360 may be coupled to a first rod end of the first rod 365. The first rod 365 may have the first rod end and a second rod end. The first rod 365 may be inside the cable connector body 305. The first rod 365 may be pivotally coupled to the second rod 370. The second rod 370 may have a third rod end and a fourth rod end. The second rod end may be pivotally coupled with the third rod end. The forth rod end may be coupled to the strut 310 between the first strut end and the second strut end.

The deflector 375 may be coupled to the cable connector body 305 so that it may engage the first rod 365 and second rod 370 when the button 360 is pressed. The deflector 375 may cause the first rod 365 and the second rod 370 to move the strut 310. The spring 380 may have a first spring end and a second spring end. The first spring end may be coupled to the cable connector body 305. The second spring end may be coupled to the strut 310 between the first strut end and the second strut end.

The spring 380 may apply a force to the strut 310 to retract the strut 310 when the pressure is released from the button 360. Therefore, when the cable connector 300 is engaged with the device 150 the surface of the device 150 engages the button 360 to move the strut 310 to the actuated position. When the cable connector 300 is unplugged from the device 115, the button 360 is released resulting in the strut 310 returning to the retracted position by a force of the spring 380.

Figure 4:
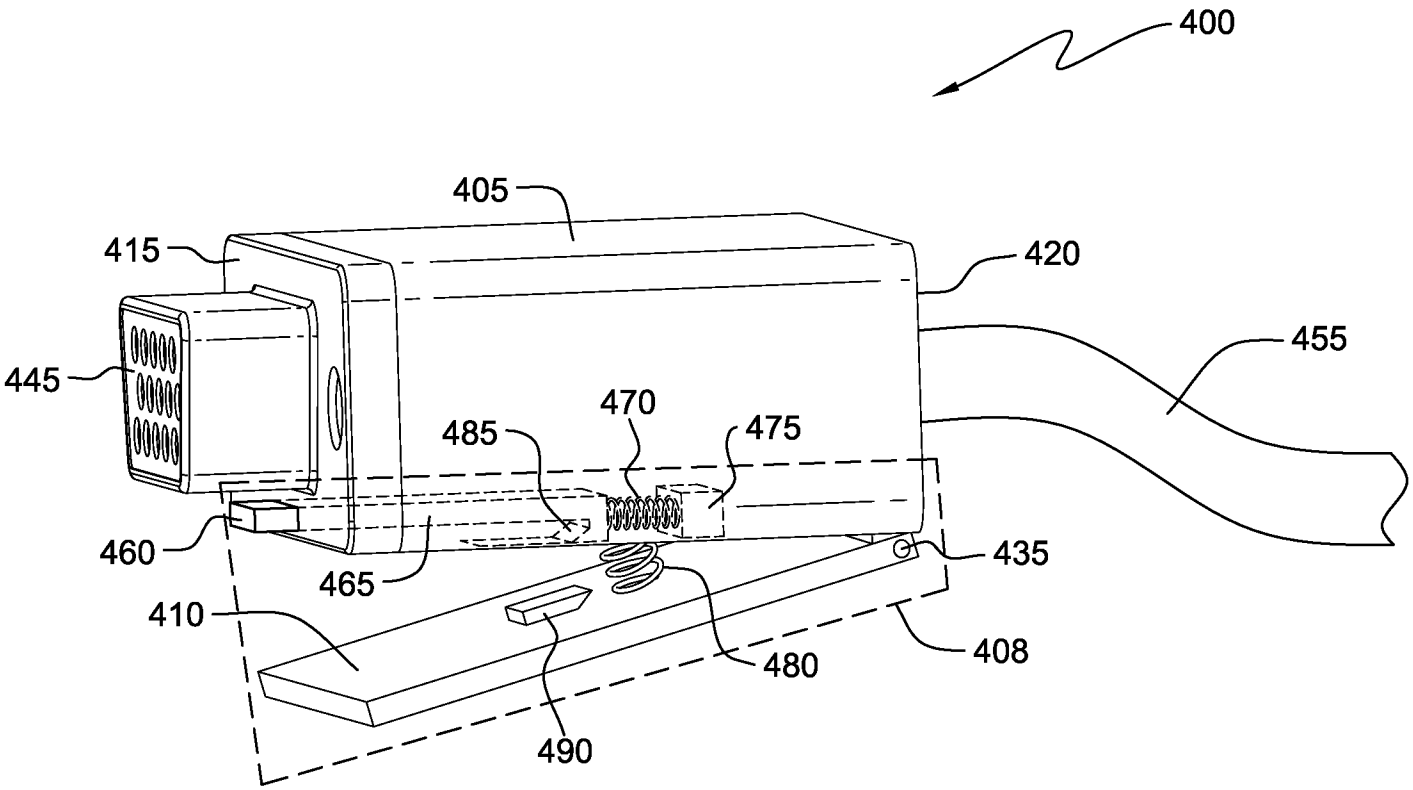
FIG. 4 illustrates a side view of the cable connector of FIG. 3 with an alternative strut assembly, according to an embodiment.

FIG. 4 illustrates a side view of an alternative strut assembly 408 for a cable connector 400, according to an embodiment. The cable connector 400 may include a cable connector body 405, and the strut assembly 408. The cable connector body 405 may include a device end 415 and a cable end 420. The cable connector body 405 in FIG. 4 is illustrated as a rectangular prism, however, shapes such as a cylindrical shape or other polygon shapes may be considered for the cable connector body 405. At the device end 415 of the cable connector body 405, there may be a cable connector terminal 445. The cable connector terminal 445 may provide a communicative coupling between the cable connector 400 and a mating connector 147 of the device 150 of FIG. 1. At the cable end 420, a cable 455 carrying electrical or optical signals may be coupled with the cable connector body 405 so that it is in operable communication with the device 150 when the cable connector terminal 445 is coupled to the mating connector 147.

The strut assembly 408 may be an automatic strut assembly. The strut assembly 408 may include a strut 410, a button 460, a rod 465, a first spring 470, a deflector 475, and a second spring 480. The strut 410 may have a first strut end and a second strut end. The strut assembly 408 may be on a bottom side of the cable connector body 405. The rod 465 may have a first rod end and a second rod end. The first spring may have a first spring end and a second spring end. The second spring may have a third spring end and a fourth spring end.

The strut 410 may be pivotally coupled to a pivot point 435 (e.g. hinge or pin) between the device end 415 and cable end 420 of the cable connector body 405. The button 460 may be external to the device end 415 of the cable connector body 405. The button 460 may be coupled to the first rod end of the rod 465 that may be inside the cable connector body 405. The second rod end may be coupled to the first spring end of the first spring 470. The second spring end may be coupled to the deflector 475 or in other embodiments the cable connector body 405. The second spring 480 may be coupled at the third spring end to the cable connector body. The fourth spring end may be coupled to the strut 410 between the first strut end and the second strut end.

The rod 465 may also have a first securing structure 485 that may couple with a second securing structure 490 on the strut 410, when the strut assembly 408 is in a retracted position. The first securing structure 485 and second securing structure 490 may decouple when the button 460 is depressed for the strut 410 to move to the actuated position.

The deflector 475 may be coupled to the cable connector body 405 so that it may engage the first spring 470 when the button 460 and rod 465 are depressed. When the cable connector 400 is engaged with a device 150, the button 460 may engage the device 150 resulting in the first spring 470 being depressed. The first securing structure 485 and the second securing structure 490 may disengage, which may allow the second spring 480 to actuate the strut 410 by applying a spring force to the strut 410. The strut 410 may be actuated at an angle with respect to the cable connector body 405. In another embodiment, gravity may actuate the strut 410 eliminating the need for the second spring 480. When the cable connector 400 is disengaged from the device 150, the pressure on the button 460 may be released resulting in the first spring 470 pushing the rod 465 and button 460 back to an undepressed position. A user may then secure the first securing structure 485 to the second securing structure 490 by pushing the strut 410 into the retracted position.

While the struts and strut assemblies have been shown on particular sides of cable connectors, in various embodiments the struts and strut assemblies may be provided on any suitable side. In addition, there may be more than one strut assembly per side. Moreover, pivot points may be located at any suitable location between the respective ends of a cable connector.

While embodiments have been described with reference to the details of the embodiments shown in the drawings, these details are not intended to limit the scope of the invention as claimed in the appended claims.

What is claimed is:

1. A cable connector for coupling a cable with a device having a mating connector, comprising:

a cable connector body having a device end, a cable end, a bottom side, and a pivot point on the bottom side between the device and cable ends;

a strut having a first strut end pivotally coupled with the pivot point and a second strut end, wherein the strut is operable to rotate between a retracted position and an actuated position and the second strut end is adapted to engage the device on a surface of the device below the mating connector in the actuated position;

a button disposed in a surface of the device end of the cable connector body;

a first rod with a first rod end and a second rod end, the first rod end coupled to the button;

a second rod with a third rod end and a fourth rod end, the third rod end pivotally coupled to the second rod end and the fourth rod end coupled to the strut between the first strut end and a second strut end; and a spring with a first spring end and a second spring end, the first spring end is coupled to the cable connector body and the second spring end is coupled to the strut, wherein when the button is depressed, the first rod and the second rod actuate the strut to the actuated position and when the button is released the spring returns the strut to the retracted position.

2. The cable connector of claim 1, wherein the second strut end is adapted to engage a strut receptacle on a surface of the device below the mating connector in the actuated position.

3. The cable connector of claim 1, further comprising:

a cable coupled to the cable connector body at the cable end.

4. The cable connector of claim 1, further comprising:

a cable connector terminal at the device end of the cable connector body adapted to engage the mating connector.

5. A cable connector for coupling a cable with a device having a mating connector, comprising:

a cable connector body having a device end, a cable end, a bottom side, and a pivot point on the bottom side between the device and cable ends;

a strut having a first strut end pivotally coupled with the pivot point and a second strut end, wherein the strut is operable to rotate between a retracted position and an actuated position and the second strut end is adapted to engage the device on a surface of the device below the mating connector in the actuated position;

a button disposed in a surface of the device end of the cable connector body;

a first rod disposed within the cable connector body with a first rod end and a second rod end, the first rod end coupled to the button;

a first spring disposed within the cable connector body with a first spring end and a second spring end, the first spring end is coupled to the second rod end and the second spring end is coupled to the cable connector body;

a second spring with a third spring end and a fourth spring end, the third spring end is coupled with the cable connector body and the fourth spring end is coupled to the strut between the first strut end and second strut end; and a securing structure on the strut and the rod, wherein when the button is depressed a locking mechanism is disengaged and the second spring actuates the strut to the actuated position.

6. The cable connector of claim 1, wherein the strut is pivotally coupled to the cable connector body on one or more sides of the cable connector body.

7. The cable connector of claim 5, further comprising:

a cable coupled to the cable connector body at the cable end.

8. The cable connector of claim 5, further comprising:

a cable connector terminal at the device end of the cable connector body adapted to engage the mating connector.

* * * * *